United States Patent [19]

Logan

[11] 3,996,827

[45] Dec. 14, 1976

[54] CUTTER FOR MATS

[76] Inventor: Malcolm Logan, 284 Shady Drive, Palatine, Ill. 60067

[22] Filed: Aug. 25, 1975

[21] Appl. No.: 607,286

[52] U.S. Cl. ..... 83/455; 83/581; 83/614

[51] Int. Cl.[2] ..... B26D 7/02

[58] Field of Search ..... 83/455, 614, 620, 564, 83/485, 581

[56] References Cited

UNITED STATES PATENTS

| | | | |
|---|---|---|---|
| 491,307 | 2/1893 | Gaylord | 83/455 X |
| 611,238 | 9/1898 | Drinkaus | 83/455 X |
| 1,235,459 | 7/1917 | Gaffney | 83/455 |
| 2,013,893 | 9/1935 | Matthews | 83/455 |
| 3,130,622 | 4/1964 | Eno | 83/620 X |
| 3,213,736 | 10/1965 | Keeton | 83/455 |
| 3,463,041 | 8/1969 | Shapiro et al. | 83/614 X |
| 3,527,131 | 9/1970 | Ellerin et al. | 83/620 X |
| 3,712,166 | 1/1973 | Rosetti | 83/614 X |
| 3,897,706 | 8/1975 | Martin | 83/455 |
| 3,918,337 | 11/1975 | Lindblad et al. | 83/614 X |

*Primary Examiner*—Frank T. Yost
*Attorney, Agent, or Firm*—Samuel W. Kipnis

[57] ABSTRACT

A cutter for mat frames which includes a cutter head, including a pair of blade carrying cutter blocks, slidable along a cutter bar and having a plurality of adjustable stops for accurately positioning and cutting of a mat board without over or under cutting. The assembly also includes means to limit the depth of the cut by one of the cutter blocks and means to lock the other cutter block in cutting position. Also included in the cutter is an adjustable handle frame which includes a cutter bar along which the cutter head is guided.

11 Claims, 10 Drawing Figures

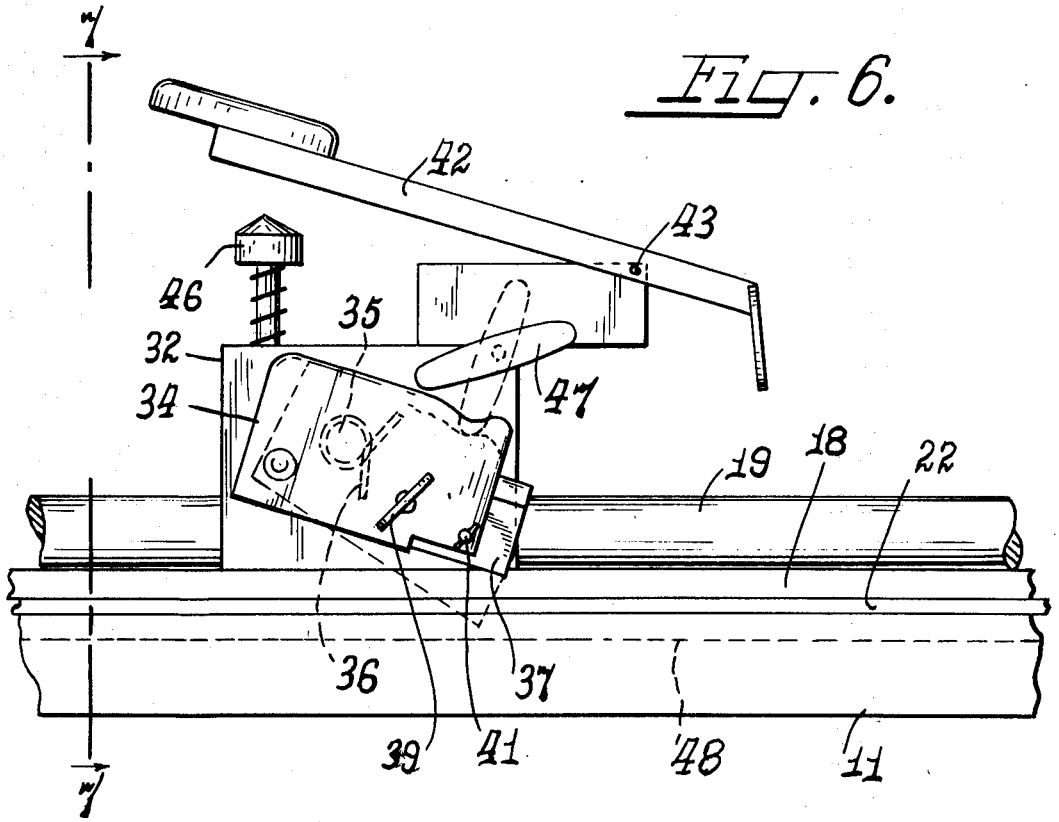
Fig. 6.
Fig. 7
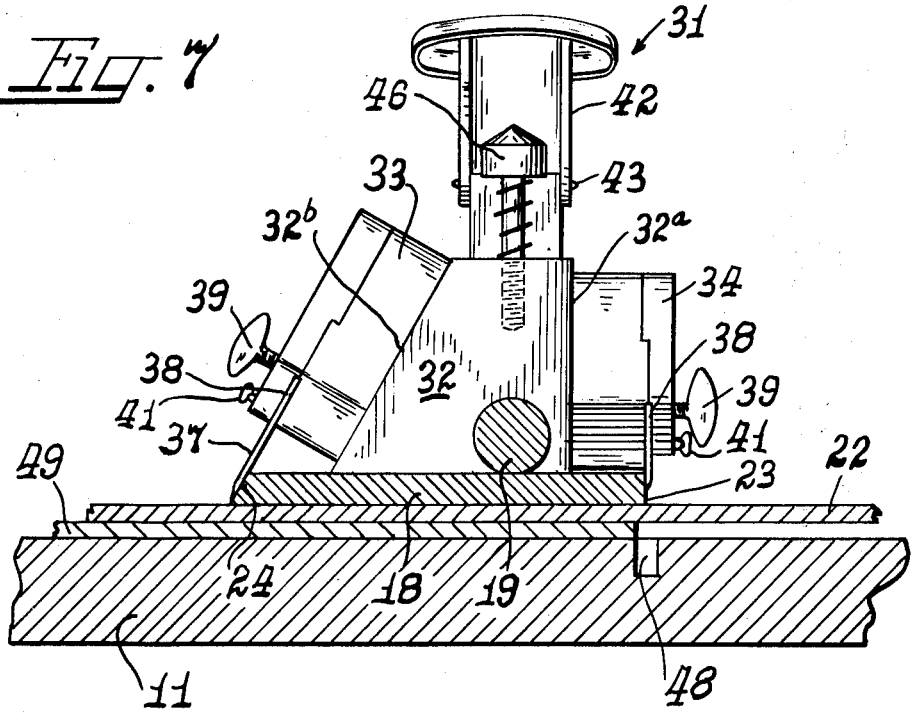

CUTTER FOR MATS

The invention relates to improvements in a cutter for mat boards used generally in the framing of pictures. Such mat boards are formed from paper stock such as cardboard and are provided with openings, square or rectangular, of various size within which a picture is framed.

Heretofore, insofar as is known, similar devices, such as one disclosed in Keeton U.S. Pat. No. 3,213,736, issued Oct. 26, 1965, accomplish the same general purpose but because of its construction and mode of use, considerable difficulty is encountered not only in operation but also, and more important, in seeking to obtain a clean cut and true and exact meeting of component edges at the corners of the cut without overcutting or undercutting. Further, difficulty is also experienced in seeking to align the mat board with the cutter so as to obtain a true aligned cut either during the cutting out of the opening or while shearing a mat board to the desired size. The present apparatus also embodies means to lock one of two cutter blade holders thereon in a cutting position and to control the applied manual pressure on the other of said blade holders so as to limit the depth of the cut in the mat board. Furthermore, the present construction embodies novel means to adjust the clamp or handle frame that carries the cutter head so as to insure proper alignment thereof.

It is therefore an object of the invention to provide a cutter for mat boards of the character referred to.

Another object is to provide a structure of the character referred to which is accurate in its operation and easily and quickly adjusted.

Another object is to provide a cutter of the character referred to with a novelly constructed cutter head.

Another object is to provide a cutter head with novelly actuated blade holders.

Another object is to provide adjustable means on the cutter head to limit downward movement of at least one of the blade holders.

Another object is to provide novel cam means for locking one of the blade holders in cutting position.

Another object is to provide a handle frame on which the cutter head is mounted, which can be angularly adjusted to insure proper alignment.

Another object is to provide the apparatus with a cutter bar that is so mounted as to lie flat on the top surface of the mat board, thus holding the mat board against displacement.

Another object is to provide a cutter of the character referred to with novel means to hold the cutting blades in close proximity to the cutting edge of the cutter bar.

Another object is to provide a cutter with means to align the mat board squarely with the cutting bar.

Other objects and advantages of the invention will become apparent with reference to the following description and accompanying drawings.

IN THE DRAWINGS

FIG. 6 is an enlarged elevational view of the other side of the cutter head.

FIG. 7 is an end elevational view of the cutter head as viewed along line 7—7 of FIG. 6.

Figure 3:
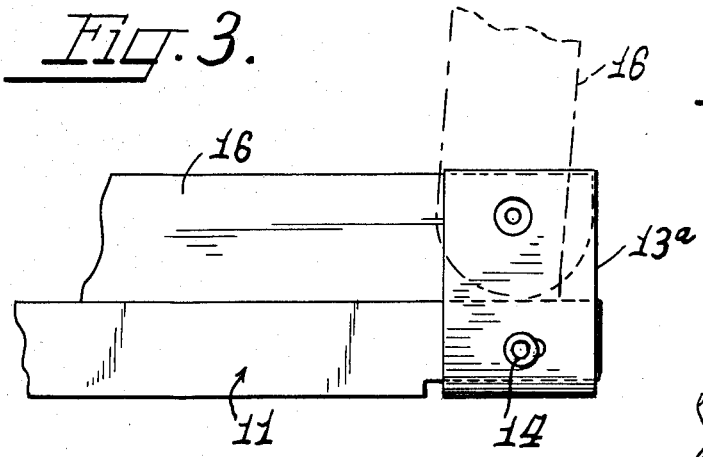
FIG. 3 is an enlarged detail of the handle frame angular adjustment.

Referring to the exemplary illustration of the mat cutter shown in the accompanying drawings, the structure includes a substantially rectangular base 11 having a planular top or work supporting surface 12. Arranged at opposite ends of the base, adjacent to one longitudinal edge thereof, are a pair of longitudinally aligned upstanding bearing plates 13, 13*a*. The bearing plate 13 is rigidly secured to the base, whereas the bearing plate 13*a* is secured thereto as by a screw 14 so as to be laterally adjustable for a purpose to be explained presently. A clamp frame 15 is mounted to lie flat upon the work surface 12 when in use and to be elevated therefrom (dotted lines in FIG. 3) when not in use. This clamp frame is comprised of a pair of end bars 16 and a connecting handle bar 17, firmly secured to complemental ends of the end bars. The end bars are pivotally secured at their other ends, one to each of the bearing plates 13, 13*a*. Because the bearing plate 13*a* is laterally adjustable on base 11, the clamp frame may be adjusted angularly relative to the base so as to insure longitudinal alignment of a cutter bar 18 which bridges the distance between and is connected to the end bars 16. The cutter bar preferably has a friction surface on its bottom face.

The cutter bar 18 has firmly secured to its top surface, a rod 19 that has its ends journalled, as at 21, in the respective end bars 16. This manner of mounting enables the cutter bar to lie on a mat board 22, which is laid on the work supporting surface for the purpose of being sheared or cut, when the clamp frame is on down position over the top of said mat board. The cutter bar has two parallel longitudinal edges 23, 24. As best shown in FIG. 7, the edge 23 forms a right angle to the plane of the cutter bar 18 whereas the edge 24 forms an obtuse angle to said plane.

Figures 1, 2:
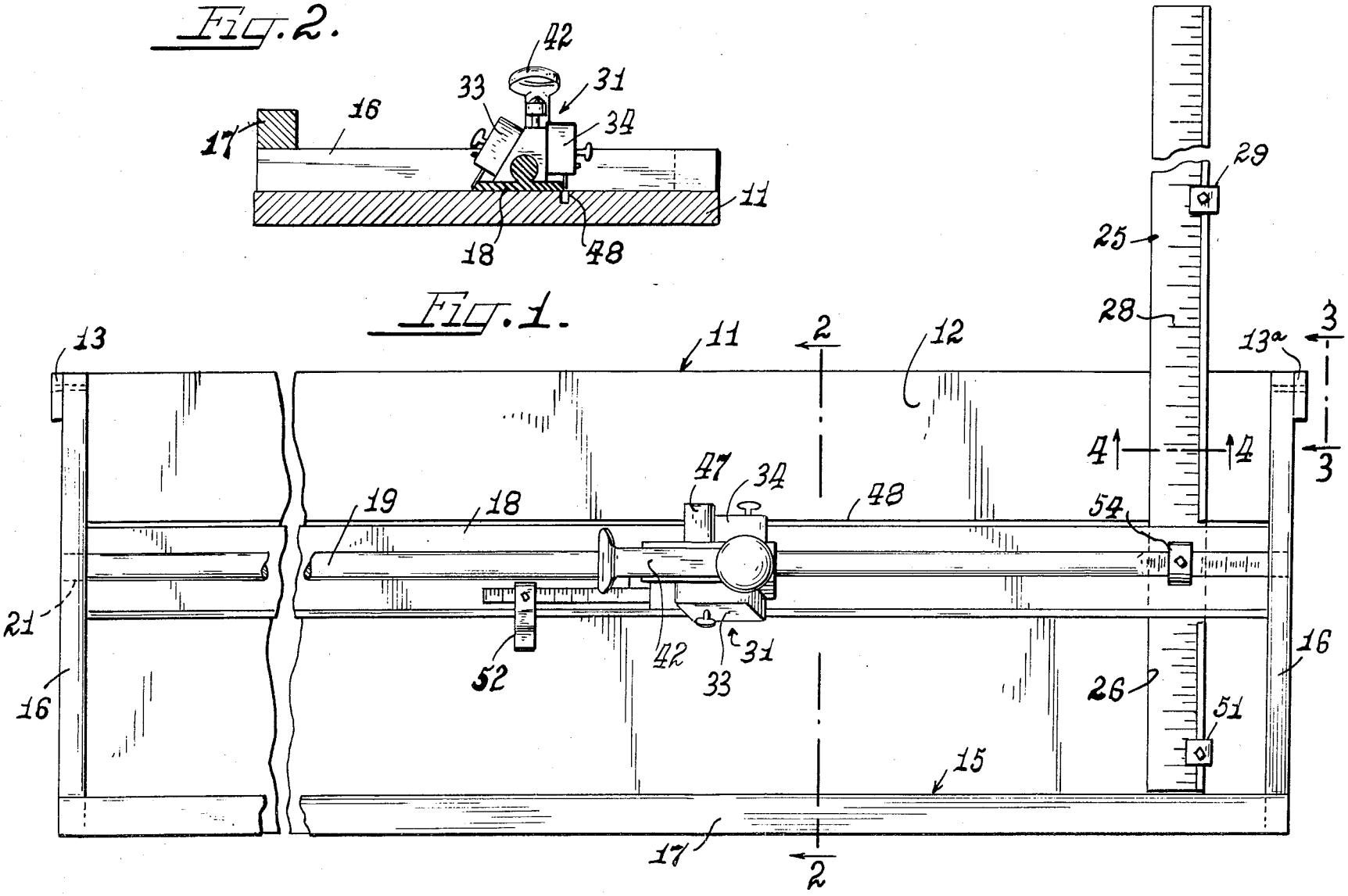
FIG. 1 is a top plan view of the mat cutter showing portions broken away.
FIG. 2 is a lateral sectional view thereof, taken substantially along line 2—2 of FIG. 1.
Figure 4:
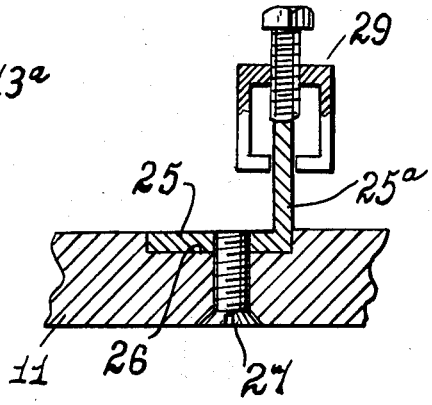
FIG. 4 is a detail sectional view of the squaring bar showing an adjustable stop thereon, taken substantially along line 4—4 of FIG. 1.

In order that a mat board 22 can be properly aligned parallel to the longitudinal edges of the cutter bar, there is provided adjacent one end of base 11, a squaring angle 25. This angle, which is a right angle in section, is laid in a channel 26 (FIG. 4) formed in the work supporting surface and its upstanding flange 25*a* forms an abutment for the related edge of the mat board. The upstanding flange 25*a* is cut away (FIG. 1) in the region of the cutter bar 18 so that the said squaring angle can underlie the cutter bar without interfering with it's operation. The squaring angle has its end secured, as by screws 27, to the base 11. It carries a scale 28 and a related adjustable stop 29 which can be pre-set to a desired position for locating the trailing edge of the mat board 22 in position to be cut out to size. Should, for example, a mat board 15 inches wide be desired, the stop 29 on the squaring angle is set at 15 inches on the scale 28. The mat board is then placed under the cutting bar 18 with its trailing edge in abutment with stop 29. A cutter head 31, to be described presently, is then advanced along said cutter bar to cut the mat board to the desired size.

Figure 5:
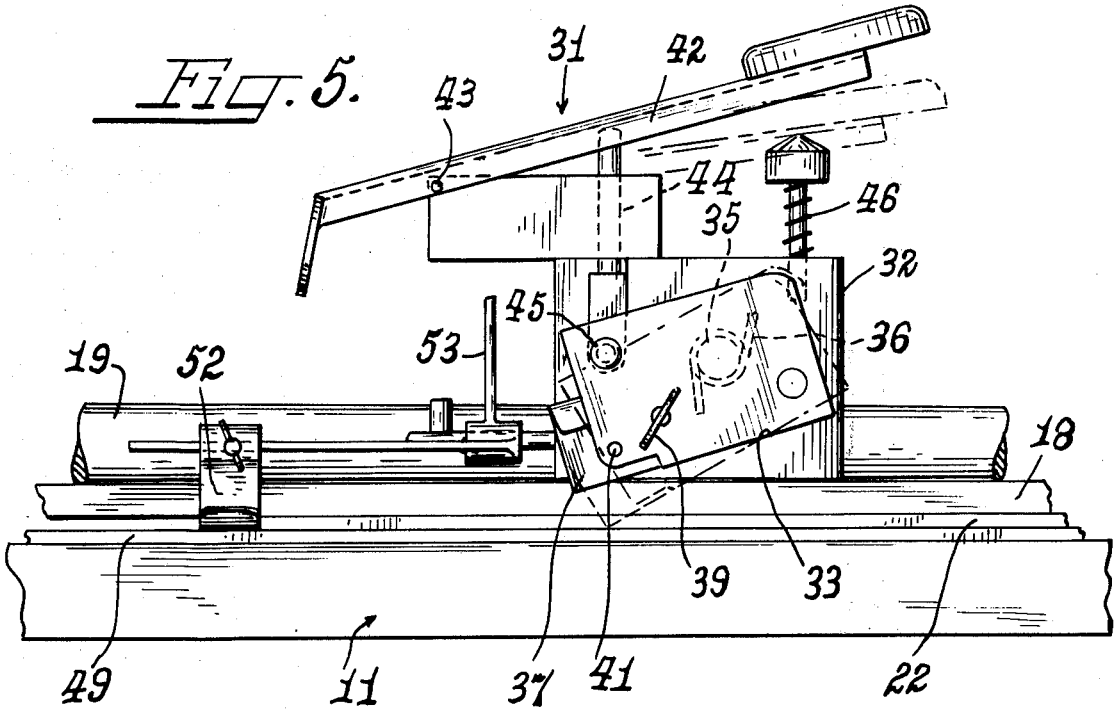
FIG. 5 is an enlarged elevational view of one side of the cutter head.

The cutter head 31 is provided to effectively, quickly and accurately perform cutting of the mat board, both straight and angular cuts. The cutter head 31 which is best shown in FIGS. 5, 6 and 7 is comprised of a block 32 slidable along rod 19. The face 32*a* of said block, disposed on the side of the cutter bar having the right angle edge 23, is perpendicular; whereas the face 32*b* of said block disposed on the side of the cutter bar having the acute angle edge 24, is angularly disposed parallel to said edge. These faces each mount, pivotally, a blade holder 33 or 34, both of which are structurally alike and will now be described.

The blade holders 33 or 34 each comprise a substantially rectangular split body suitable mounted pivotally about an axis 35 to the respective face 32*a* or 32*b* of the sliding block 32. Spring means 36 coacts with each block to hold it in an angularly elevated position (FIGS. 5, 6) with its cutting blade 37 above the surface of the mat board. The bottom edge area of each blade holder 33, 34 is suitably recessed, as at 38, to receive therein the cutting blade. The blades are removably retained in their respective recesses 38 by a set screw 39.

Figure 8:
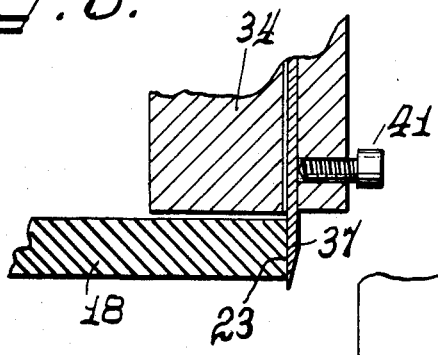
FIG. 8 is a detail of the blade holder showing the blade tensioning screw.

When the blade holders 33, 34 are tilted downwardly by means to be described presently, the cutting edges of the cutter blades 37 are carried downwardly past the related longitudinal edges 23, 24 of the cutter bar 18, for cutting the mat board 22. In order to insure that the blades are in substantial surface contact with the related cutter bar edges, there is provided in each blade holder a knurled adjusting screw 41 (FIG. 8) which bears against the side of the blade to urge it toward the related cutting edge 23 or 24. This prevents the generation of a slight curve in the performed cut which could result from slight movement of the blade away from the related cutting edge while cutting the mat board.

Rocking movement of the inclined blade holder 33 toward the mat board for cutting said board is accomplished by manually pressing a lever 42, pivoted at 43 on the top side of the cutter head block 32, downwardly. This lever then bears down on a reciprocable rod 44 arranged in the cutter head block, which rod has a pivotal connection at 45 with an end portion of the blade holder. The depth to which the cutter blade 37 carried by said holder 33 is regulated by an adjustable stop knob 46 carried by the cutter head block 32.

The other, or vertically movable blade holder 34 is similarily mounted and is carried downwardly into cutting position and locked down by a manual cam lock 47 which is rotatably mounted on the related side of the block 32.

The blade 38, in the vertical blade holder 34, can be carried downwardly through the mat board into the longitudinal groove 48 in the work supporting surface of base 11. The other or inclined blade holder 33 has no such groove beneath its blade 37 and consequently it must not be lowered beyond the work supporting surface of the base. In fact, when cutting with this inclined blade, there is a backing sheet 49 of mat board or other material laid beneath the mat board 22 to be cut so as to allow the blade 37 to pass clear through the mat board 22 and but slightly into the underlying sheet 49.

OPERATION

Figure 9:
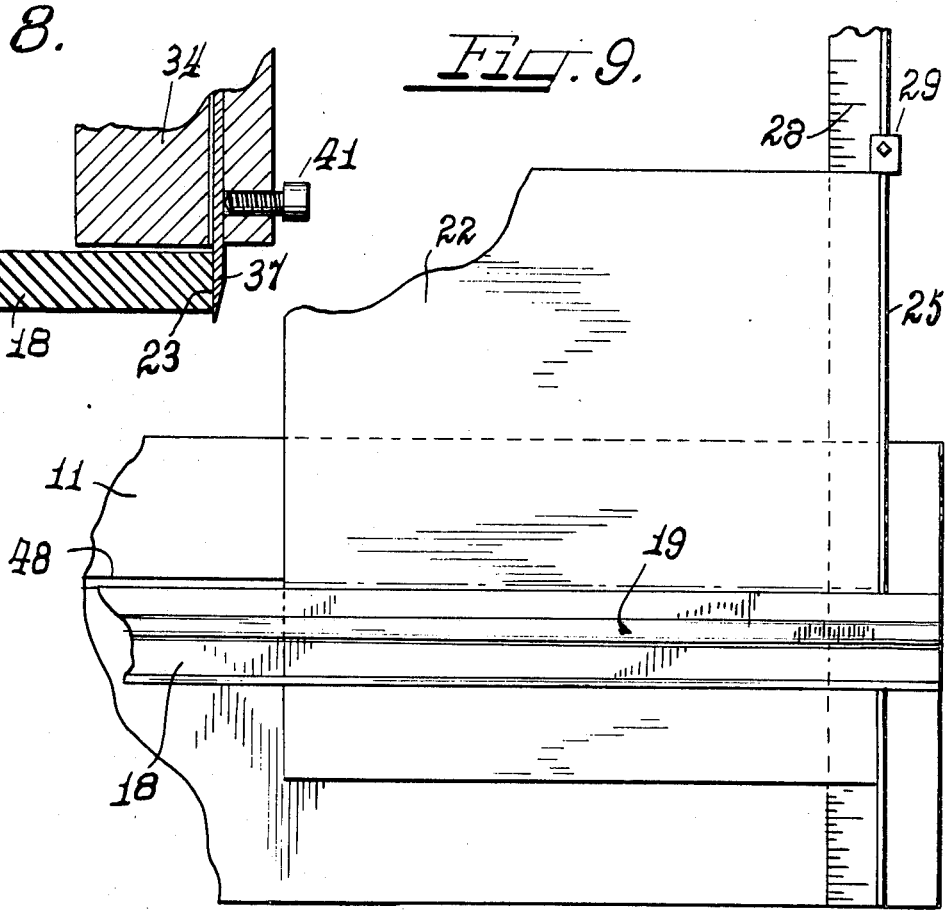
FIG. 9 is a fragmentary plane view of the cutter showing a mat board positioned thereon for size trimming.

To initiate cutting operation, the clamp frame 15 is raised into a substantially vertical position clear of the work supporting surface of base 11. Should the mat board be too large and require trimming, the board is placed on the work surface with its trailing edge positioned at the desired dimension relative to the scale 28 (FIG. 9). The clamp frame 15 is then lowered thereover and because of the swivel mounting for the cutter bar 18, said bar will lie flat against the mat board holding same. The cam lock 47 (FIG. 6) is then rotated into the dotted line position shown to carry the straight cut blade holder 34 down into the mat board and the cutter head 31 is then moved across the mat board (to the right in FIG. 1) so as to sever the excess board. Should repeat operations be required in order to cut a plurality of mat boards of like size, the position stop 29 on lateral guide 25 is brought against the trailing edge of the first mat board and secured. Thus, successive mat boards requiring trimming can be laid on the working surface and trimmed without further adjustment.

Figure 10:
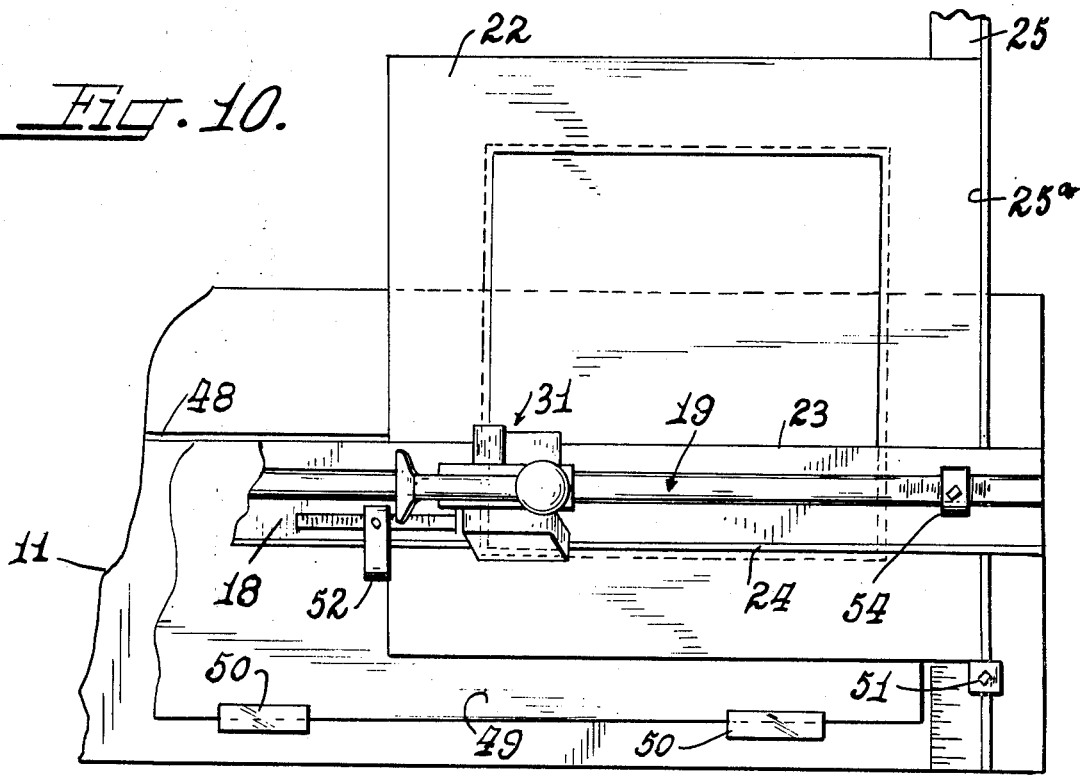
FIG. 10 is a view similar to FIG. 9 showing the mat board positioned for border cutting.

Now, with the mat board cut to size, the backing sheet 49 is laid on the work supporting surface with one longitudinal edge aligned with the nearest edge of the longitudinal groove 48. It may be secured against displacement by use of strips of adhesive tape 50 arranged along its edges except along the edge aligned with groove 48. The trimmed mat board 22 is laid on the work supporting surface, face down (FIG. 10) and is ready to be cut out. Preliminary to cutting it is determined whether the mat frame border is to be, say 3 or 4 inches wide. In other words the length of the bevel cut and its position on the mat board is to be determined and the various stops adjusted to give effect to this determination. Thus, a squaring angle stop 51 (FIGS. 1 and 10) is set at 3 inches and the lead edge of the mat board is positioned in abutment therewith. This locates the bevel edge 24 on the cutter bar 3 inches from the lead edge of the mat board. A releasable stop 52 (FIG. 5) carried on the left hand end of the cutter head 31 is adjusted to the 3 inches marking on its scale, and a cutter head stop 54, to the right of the cutter head, is set at the 3 inches marking on its scale.

The handle bar 15 is then lowered onto the mat board and the cutter head 31, with the blade 37 elevated, is positioned over the mat board to the left (FIG. 10) with its releaseable stop 52 abutting the left hand edge of the mat board. This will locate the cutting blade 3 inches in from the said edge of the mat board. After this setting, the stop screw 46 for limiting the depth of the cut to be made is adjusted and the handle 42 is then depressed by the palm of the hand to carry the bevel cutter blade 37 down into the mat board. Sliding the cutter head 31 to the right is then accomplished upon releasing the movable stop 52 by finger engagement with a pin 53 thereon. This allows the stop to slide freely over the top surface of the mat board while the cutter head is advancing to the right to make the first bevel cut.

The clamp handle bar 15 is now lifted off the mat board and said board is turned 90° to position it for a second cut. The stops need not be further adjusted and it is only necessary to relocate the cutter head at the left hand edge of the mat board and repeat the cutting operation by depressing the hand lever 42 and moving the cutter head to the right. This procedure is again repeated for the remaining sides of the mat frame. The precise setting of the stops 52 and 54 insures that there is no overcut or undercut at the corners of the frame. Should it be intended to cut the mat board with, for example, a 4 inches border on one side, the square angle stop 51 is set at 4 inches for the first bevel cut and then reset at 3 inches for the remaining three cuts.

It should be quite evident that the mat board may be cut to the required border easily and quickly with but a minimum of preliminary setting of stops and without the necessity of marking the mat boards. Thus the entire operation is faster and more accurate than in previous methods.

Although I have described a preferred embodiment of the invention, in considerable detail, it will be understood that the description thereof is intended to be illustrative rather than restrictive, as details of the structure may be modified or changed without departing from the spirit or scope of the invention. Accordingly, I do not desire to be restricted to the exact construction described and shown.

I claim:

1. A cutter for picture frame mats comprising, a rectangular base having a planular work supporting surface, a rectangular clamp frame including end bars and a connecting handle bar carried by the base, hinge means connecting the end bars to one longitudinal edge of the base in a plane spaced above the work supporting surface so as to allow the clamp frame to lie flat against the base, a cutter bar journalled intermediate the ends of and bridging the space between said end bars, said cutter bar having parallel longitudinal edges, one of said edges forming an acute angle to the plane of the cutter bar and the other forming a right angle to said plane, a cutter head slidable along said cutter bar, and a pair of cutting blades movably carried by the cutter head one disposed for cooperation with each longitudinal edge of the cutter bar.

2. The cutter recited in claim 1, wherein one of said hinge means is adjustable laterally of the base.

3. The cutter recited in claim 1, which includes adjustable stop means for the cutter head adjacent to one end of the cutter bar.

4. The cutter recited in claim 1, which includes a scale on the cutter head having a movable stop to engage an edge of the mat board located beneath the cutter bar.

5. The cutter recited in claim 1, wherein laterally extending guide means is carried by the base.

6. The cutter recited in claim 5, wherein the lateral guide means has adjustable stops thereon.

7. The cutter recited in claim 1, which includes a handle pivotally mounted on the cutter head to manually hold the cutter blade cooperating with the acute angle edge of the cutter bar in cutting position.

8. The cutter recited in claim 7, wherein the handle is pivoted and located on the top side of the cutter head.

9. The cutter recited in claim 1, which includes lock means for holding the cutter blade cooperating with the right angle edge of the cutter bar in a cutting position.

10. The cutter recited in claim 1, wherein the cutter head includes a pair of pivotally mounted blade holders.

11. The cutter recited in claim 10, wherein each blade holder includes means to hold its respective blade in close association with the respective cutting edge.

* * * * *